US006161560A

United States Patent [19]

Brink

[11] Patent Number: 6,161,560

[45] Date of Patent: Dec. 19, 2000

[54] SEALED AQUEOUS SELF-CLEANING RINSE SUMP FOR AQUEOUS SPRAY WASHERS

[75] Inventor: Christopher J. Brink, Bowling Green, Ky.

[73] Assignee: Detrex Corporation, Bowling Green, Ky.

[21] Appl. No.: 09/259,816

[22] Filed: Feb. 26, 1999

[51] Int. Cl.[7] ..... B08B 3/02

[52] U.S. Cl. ..... 134/72; 134/108; 134/114; 134/131

[58] Field of Search ..... 134/72, 105, 107, 134/108, 114, 131

[56] References Cited

U.S. PATENT DOCUMENTS 5,553,633 9/1996 Ciccarelli, Jr. et al. ..... 134/131 X

FOREIGN PATENT DOCUMENTS 925431 5/1982 U.S.S.R. ..... 134/72

1585021 8/1990 U.S.S.R. ..... 134/107

*Primary Examiner*—Philip R. Coe

*Attorney, Agent, or Firm*—Harness, Dickey & Pierce, P.L.C.

[57] ABSTRACT

A sealed aqueous self cleaning rinse sump is provided for an aqueous spray washer. The rinse sump is pressurized by a weir restriction which directs return fluid into the rinse sump while simultaneously providing a pressure seal at the inlet of the rinse sump. The pressurized sump facilitates evaporation of the rinse fluid in order to separate contaminants out of the rinse fluid. The evaporated rinse fluid is then condensed and then returned to the rinse sump, thereby providing a consistently acceptable supply of clean rinse fluid.

18 Claims, 3 Drawing Sheets

SEALED AQUEOUS SELF-CLEANING RINSE SUMP FOR AQUEOUS SPRAY WASHERS

BACKGROUND OF THE INVENTION

1. Field of the Invention

The present invention relates to a sealed aqueous self cleaning rinse sump for aqueous spray washers and, more particularly, to a rinse sump using a water seal to safely pressurize the rinse sump to facilitate purifying the rinse water.

2. Discussion

Production of many electronic components, such as circuit boards and the like, often involves coating and etching processes to fabricate the circuit boards. The circuit boards are typically passed through a sealed aqueous, belt driven, spray washer to remove etching and coating materials and the like. Such material removal steps may be part of an intermediate process or may be part of a final, finishing process. Numerous other fabrication processes exist which may similarly require intermediate or final wash and rinse steps as part of the fabrication process.

In circuit board fabrication, a typical wash and rinse cycle involves placing the product to be washed and rinsed on a conveyor belt. The conveyor proceeds into a spray washer having a wash section and a rinse section. The parts are sprayed or otherwise subjected to a wash fluid which then drains back into the wash sump. Following the wash cycle, the conveyor moves the product to a rinse section where the parts are sprayed with a rinse water. Aqueous spray washers of the type described here require as clean a rinse water as possible. Maintaining a clean supply of rinse water proves challenging because many products passed through spray washers, particularly circuit boards and the like, leave behind metals, oils, and other components in the rinse water.

Existing systems for cleaning rinse water require significant expense and time to obtain the desired purity of the rinse water. Some rinse water purification systems utilize either or both filters and membranes in order to properly clean the rinse water to maintain a generally pure rinse water concentration to provide optimal cleaning. Filters sometimes do not sufficiently purify the rinse water in accordance with the application requirements. Such systems often require very fine filter elements and often necessitate use of reverse osmosis filter systems. Filtration systems of this type requires additional, expensive apparatus, operate much more slowly in terms of filtration time and system inactivity for performing maintenance, and require greater operator intervention to periodically change filters and membranes.

Other spray washer systems completely change the rinse water periodically in order to provide clean rinse water. These systems require post-processing of the rinse water, which may contain metals which are costly to remove. Such an approach may only be cost effective for users having access to in-house water treatment facilities. A further drawback of such a system is that the rinse water will not remain consistently pure, as newly added rinse water will be much cleaner than rinse water at the end of a life cycle.

Yet another approach to providing clean rinse water utilizes a distillation process in which the rinse water in the sump is vacuumed boiled and condensed. The condensed water returns to the sump, and the returned rinse water is generally clean, while the contaminants in the rinse water have been removed by falling to the bottom of the sump. The vacuum distillation process, however, is typically a batch process. An affordable batch process apparatus has a low volume capacity and requires significant time to filter the rinse water, resulting in excessive down time. The batch process also requires significant operator intervention.

Thus, it is an object of the present invention to provide a self-cleaning rinse sump for aqueous spray washers.

It is yet a further object of the present invention to provide a rinse sump for aqueous spray washers which continuously cleans the rinse water.

It is yet a further object of the present invention to provide a rinse sump for aqueous spray washer which minimizes required operator intervention, expedites purification, and minimizes cost.

SUMMARY OF THE INVENTION

This invention is directed to a rinse station for a system for rinsing components in a spray washer. The rinse station includes a rinse area and a generally sealed reservoir for holding rinse fluid. The reservoir has an outlet for providing rinse fluid to the rinse area and an inlet for receiving fluid from the rinse area. A fluid return section collects rinse fluid from the rinse area and returns the rinse fluid to the inlet of the reservoir. A fluid seal is formed on the inlet of the reservoir with fluid returned by the fluid return section. The fluid seal enables pressurization of the reservoir. A boil chamber receives fluid from the reservoir, and the boil chamber heats the rinse fluid to cause evaporation of the rinse fluid. A condenser condenses the evaporated rinse fluid, and the condensed fluid is returned to the reservoir.

These and other advantages and features of the present invention will become readily apparent from the following detailed description, claims and drawings.

BRIEF DESCRIPTION OF THE DRAWINGS

The drawings, which form an integral part of the specification, are to be read in conjunction therewith, and like reference numerals are employed to designate identical components in the various views.

DETAILED DESCRIPTION OF THE INVENTION

Figure 1:
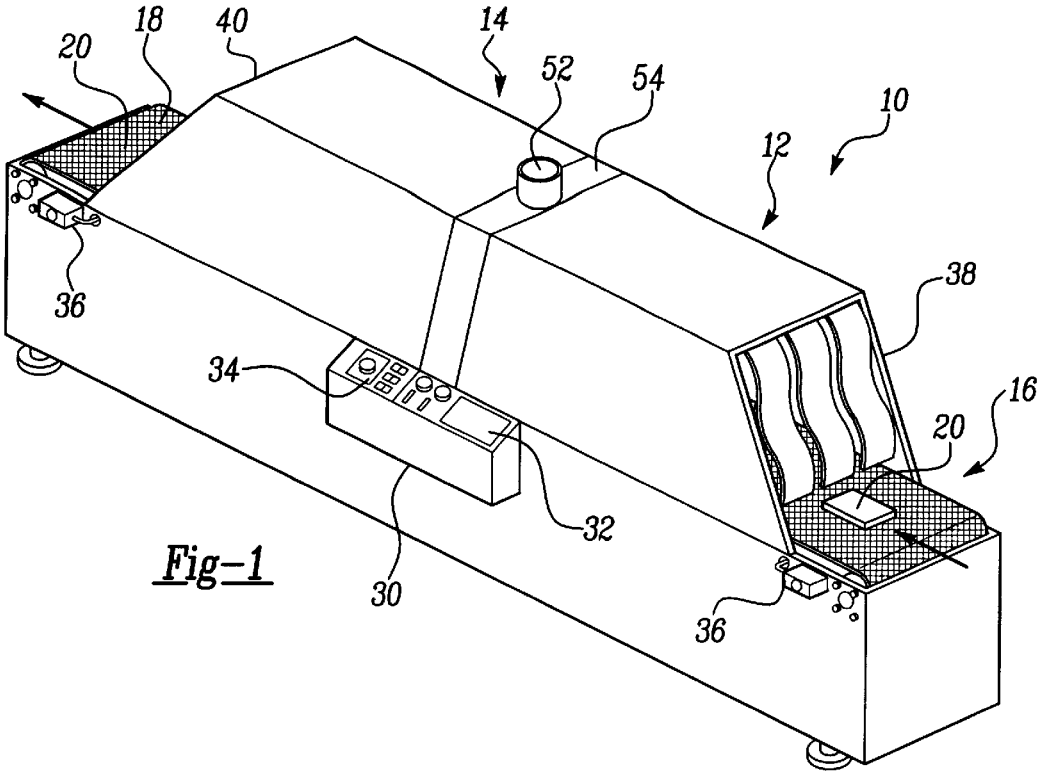
FIG. 1 is a front perspective view of an aqueous spray washer system arranged in accordance with the principles of the present invention.

With reference to FIGS. 1–5, the spray washer system 10 of the present invention will be described. Spray washer system 10 includes a wash section 12 and a rinse section 14. Product is placed on a conveyor assembly 16 which includes a conveyor belt 18. Conveyor belt 18 may be any of a number of flat-screen belts known to those skilled in the art. Of a particular importance, conveyor belt 18 enables fluid to pass through itself to provide sufficient cleaning or rinsing of product or parts 20 placed on conveyor belt 18.

Conveyor belt 18 is driven by a pair of sprockets including sprocket 22 at an input side and sprocket 24 at an output side of spray washer system 10. A tray 26 supports conveyor belt 18 between sprockets 22, 24. Sprocket 24 functions as a drive sprocket to cause linear movement of conveyor belt 18. An external power source or transfer case 28 drives sprocket 24. As best seen with respect to FIG. 3, conveyor belt 18 follows a circular path from sprocket 22 to sprocket 24 upon tray 26, then returns from sprocket 24 to sprocket 22 beneath tray 26.

A control panel 30 controls operation of spray washer system 10, as will be described further herein. Control panel 30 may have one or a number of digital displays 32 which provide temperature, pressure, and other component status information to the operator. Control panel 30 also includes operator controls 34 which may be used to operate spray washer system 10. A pair of stop switches 36 are located at either end of conveyor belt 18 to enable the operator to disable operation of spray washer system 10 without moving to control panel 30.

Spray washer system 10 has an input side 38 and an output side 40. In operation, after spray washer system 10 has been activated from control panel 30, sprockets 22, 24 cause a cyclical movement of conveyor belt 18. Product 20 is placed on conveyor belt 18 at input end 38. Conveyor belt 18 moves product 20 through spray washer system 10. Product 20 passes through curtain 42 which limits splashing of wash solution out of wash section 12. Curtain 42 is preferably formed of vinyl or other plastic material which is also preferably resistant to the particular wash solvents utilized by spray washer system 10. Conveyor belt 18 moves product 20 into wash section 12 where the product is placed under wash sprayers 44. Wash sprayers 44 are positioned above and below product 20 and conveyor belt 18 to suitably spray product 20 in wash section 12. After product 20 passes through wash section 12, conveyor belt 18 moves product 20 to rinse section 14, where rinse sprayers 46 dispense rinse water to rinse product 20. The rinse water is preferably pure, distilled water. Following the rinse cycle, conveyor belt 18 moves product 20 through output end 40 where an operator or automated machine may remove product 20 from conveyor belt 18.

Figure 2:
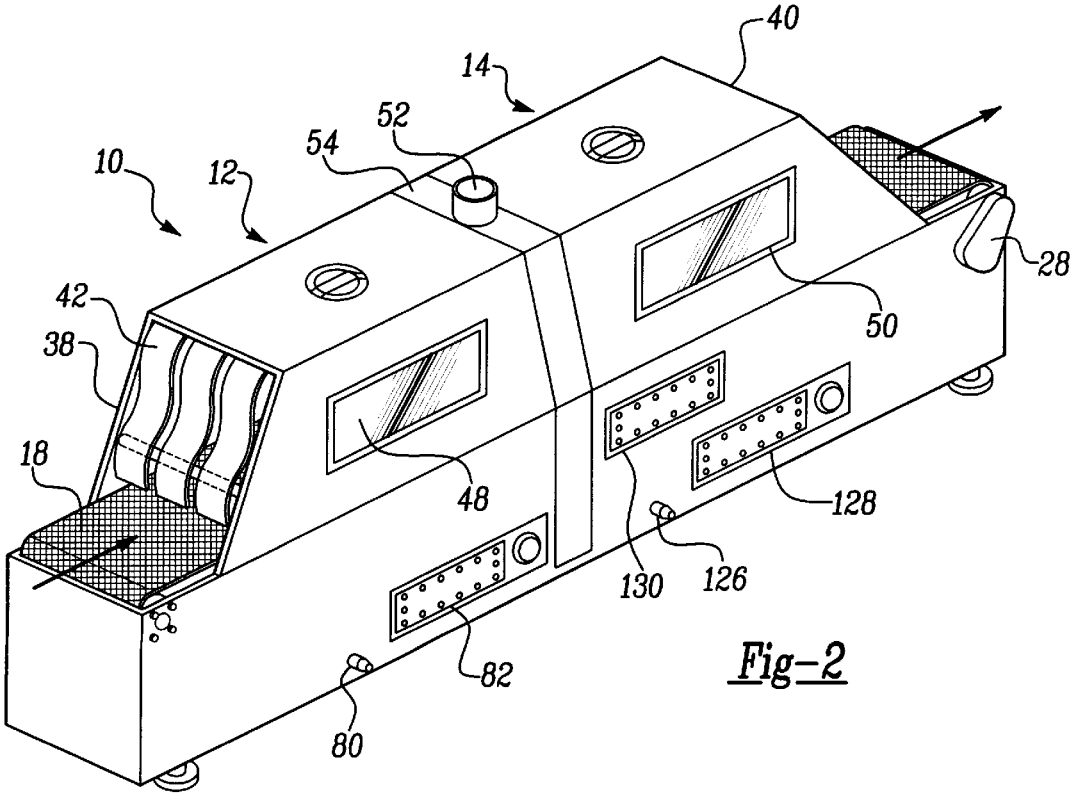
FIG. 2 is a partial cutaway, rear perspective view of an aqueous spray washer system of FIG. 1.

As best seen with respect to FIG. 2, spray washer system 10 includes an optional wash window 48 so that a user may view the product during the wash cycle in wash section 12. Spray washer system 10 also includes an optional rinse window 50 to enable the operator to view product 20 during the rinse cycle in rinse section 14. Further, an exhaust vent 52 formed above an intermediate section 54 enables air to exhaust from spray washer system 10. Intermediate section 54 is interposed between wash section 12 and rinse section 14.

Figure 3:
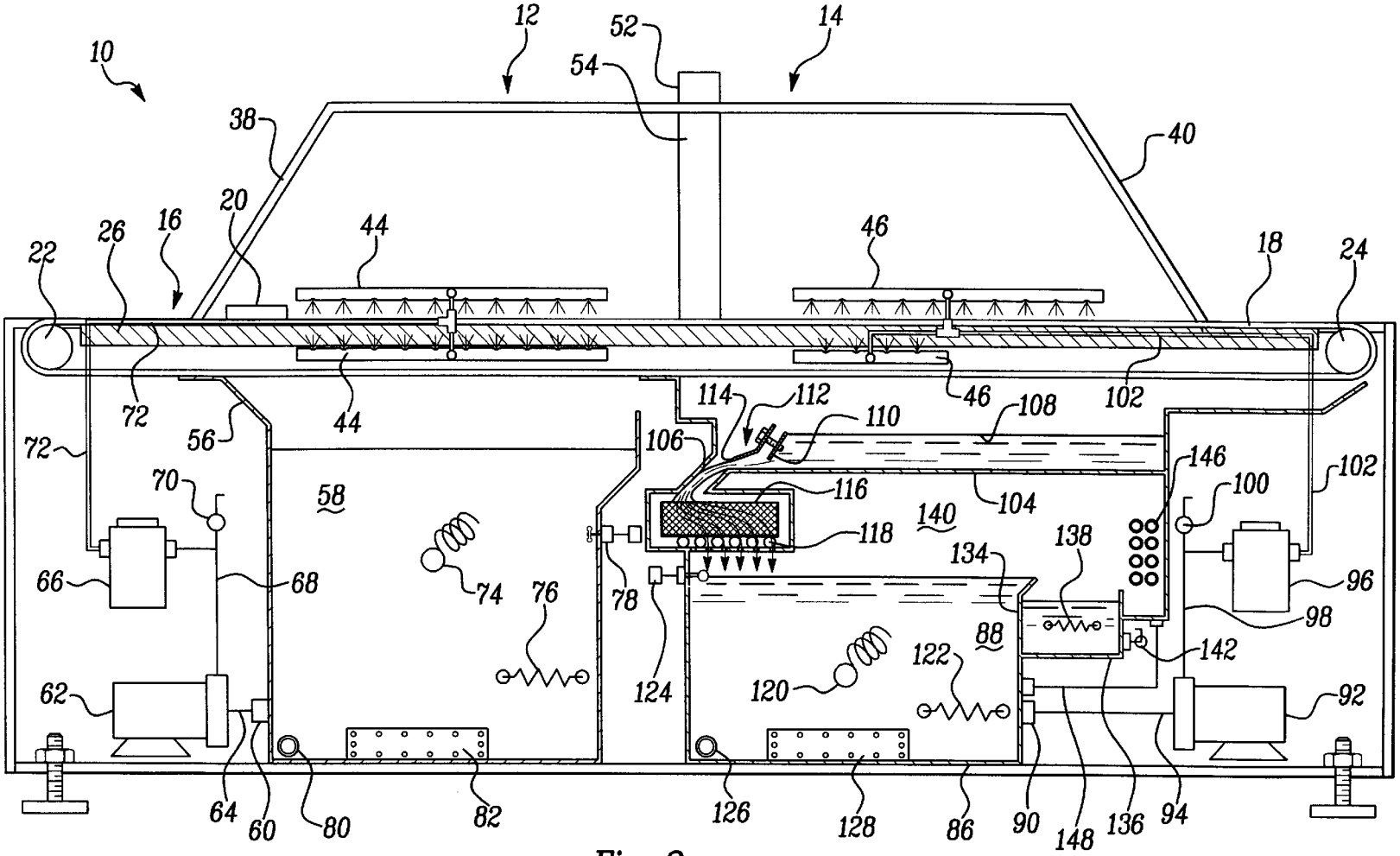
FIG. 3 is a rear, internal view of the aqueous spray washer system of FIG. 1 showing the sealed aqueous self-cleaning rinse sump arranged in accordance with the principles of the present invention.

With particular reference to FIG. 3, wash section 12 and rinse section 14 will be described in greater detail. Wash section 12 includes a wash sump 56 which contains a supply of wash fluid 58. Wash sump 56 includes an outlet 60 which provides a fluid supply to the input side of a pump 62 via conduit 64. Pump 62 outputs a fluid supply to a filter 66 via a conduit 68. Conduit 68 also includes a sump discharge drain 70 to enable draining of sump 56. With sump discharge drain 70 closed, fluid output by pump 62 passes through filter 66 into conduit 72 where it is supplied to upper and lower wash sprayers 44. Fluid output from wash sprayers 44 contacts and carries out a washing action on product 20 when placed beneath wash sprayers 44. The wash fluid drains from product 20 back to wash sump 56.

Internal to wash sump 56, a thermocouple 74 outputs an electrical signal to control panel 30. The electrical signal output by thermocouple 74 varies in accordance with the temperature of wash fluid 58. Control panel 30 monitors the output of thermocouple 74 and generates electrical control signals that control operation of heater 76. A float switch 78 also outputs an electrical signal to control panel 30 that varies in accordance with the level of wash fluid 58 within wash sump 56. In one configuration, electrical control panel 30 may generate control signals to deactivate pump 62 if the level of wash fluid 58 drops below float switch 78. Wash sump 56 may also include an auxiliary drain 80 to enable draining of wash fluid 58 independently of operation of pump 62. Wash sump 56 also includes a cleanout 82 which facilitates removal of sediment and debris from wash sump 56.

Following product washing in wash section 12, conveyor 18 moves product 20 to rinse section 14. Rinse section 14 includes a rinse sump 86 which contains rinse water 88. Rinse sump 86 includes an outlet 90 to discharge rinse water 88 to pump 92 through conduit 94. Pump 92 receives an input fluid flow from rinse sump 86 and generates an output fluid flow to filter 96 through conduit 98. Conduit 98 also includes a rinse discharge drain 100 for selectively draining rinse sump 86 through pump 92 when rinse discharge drain 100 is open. With rinse discharge drain 100 closed, fluid flows through filter 96 through upper and lower wash sprayers 46 through conduit 102. Rinse water 88 thus rinses product 20 when product 20 is positioned between rinse sprayers 46.

Following discharge from wash sprayers 46 onto product 20, rinse water 88 drains onto shed tray 104. Shed tray 104 provides an upper seal for rinse sump 88. rinse water 88 forms a head 108 upon shed tray 104. As will be described in greater detail herein, head 108 creates a pressure at inlet 110 of a weir restriction 112. Rinse water under pressure at inlet 110 flows through weir restriction 112 to the outlet 114 of weir restriction 112 and through inlet 106 of rinse sump 86. The rinse fluid then flows through a catch tray 116. Catch tray 116 is embodied as a mesh screen to catch debris or other parts which may fall off product 20. Rinse water 88 falls through catch tray 116 and through cooling rack 118. Cooling rack 118 operates as a heat exchanger to reduce the temperature of rinse water 88 upon its return to rinse sump 86. Fluid flows through cooling rack 118 into main reservoir portion 84 of rinse sump 86.

Rinse sump 86 also includes a thermocouple 120, a heater 122, a float switch 124, and an auxiliary drain 126, all of which operate as described above with respect to wash section 12. Also similar to rinse sump 56 and as best seen in FIGS. 2–3, rinse sump 86 also includes a cleanout 128 which collects sediment and other byproduct from the rinse process and enables convenient removal of such sediment and by product. As also seen with respect to FIG. 2, a second cleanout 130 may be provided to enable removal of material captured by catch tray 116.

Main reservoir 84 of rinse sump 86 includes a partition 134 to separate main reservoir 84 from a boil chamber 136. Boil chamber 136 includes a heater 138, which is controlled by control signals output by control panel 30. In operation, rinse water 88 rises within rinse sump 86 and overflows partition 134 so that rinse water spills into boil chamber 136. Heater 138 heats fluid within boil chamber 136 to evaporate fluid within boil chamber 136. During evaporation, rinse water 138 separates from sediment and other contaminants, which do not evaporate, and fills an air space 140 above rinse water 88.

A condenser 144 placed within air space 140 includes one or a number of condensing coils 146. Condensing coils 146 provide a flow path for cooling fluid to cool condensing coils 146. The evaporated rinse water in airspace 140 contacts condensing coils 146 and condenses to a liquid state. The condensed rinse water drains down into conduit 148 and returns to rinse sump 86. Sediment left behind in boil chamber 136 may be removed using drain 142.

The configuration of rinse sump 84 described herein provides a particular benefit as will be described with respect to FIG. 3. Fluid returned from shed tray 104 through inlet 106 passes through catch tray 116 and cooling rack 118 and enters rinse sump 84 toward the left side of rinse sump 84 with respect to FIG. 3. A greater proportion of sediment falls out of rinse water 88 toward the left side of rinse sump 84 upon its initial return to rinse sump 84. Purification of rinse water 88 occurs towards the right side of rinse sump 84 as shown with respect to FIG. 3. As rinse water 88 traverses the rinse sump 84 from the left to right sides, additional sediment and debris fall out prior to rinse water 88 overflowing partition 134. Further yet, condensed fluid returned to rinse sump 84 via conduit 148 returns to rinse sump 84 just above fluid outlet 90. As described above, fluid outlet 90 provides rinse water to pump 92, which ultimately provides rinse water to rinse sprayers 46. In this manner, the purified rinse water introduced to rinse sump 84 in proximity to outlet 90 feeds sprayers 46 to provide the cleanest rinse water possible.

Figure 4:
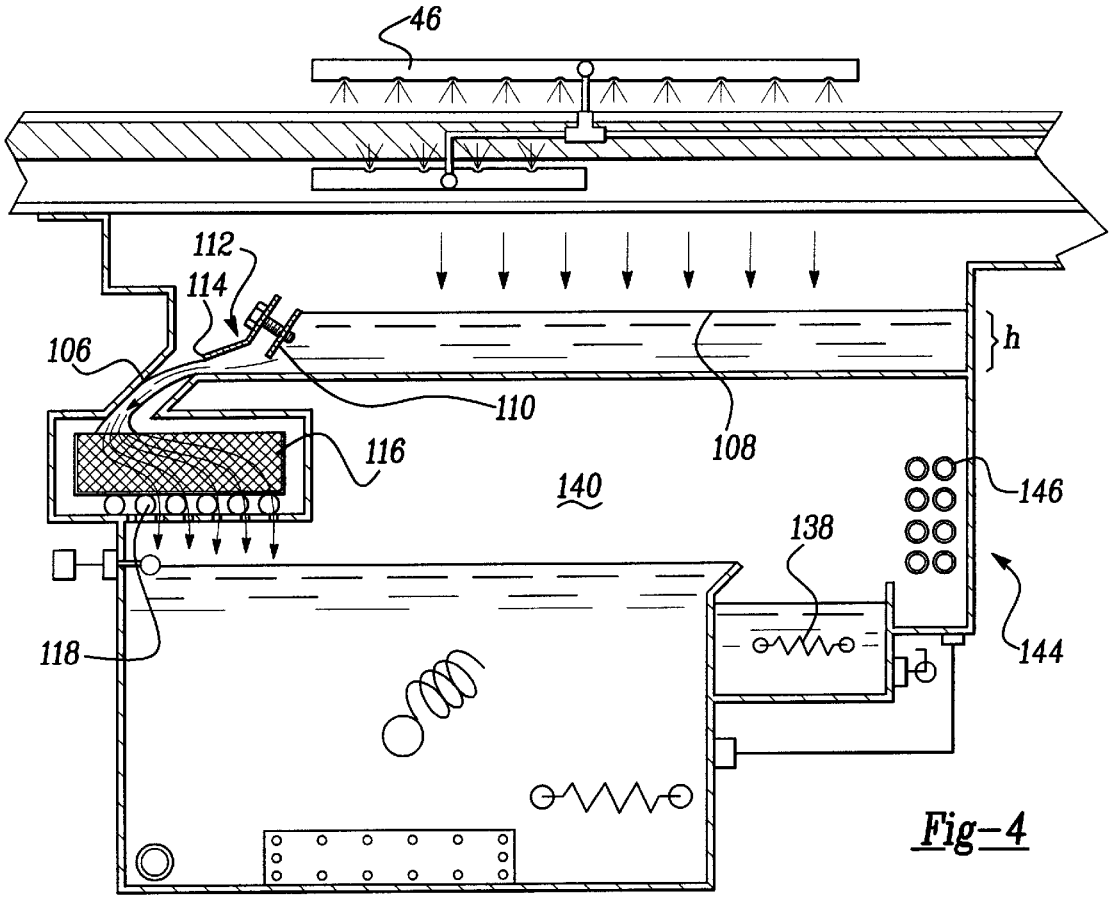
FIG. 4 is an expanded view of the sealed aqueous self-cleaning rinse sump of FIG. 3.
Figure 5:
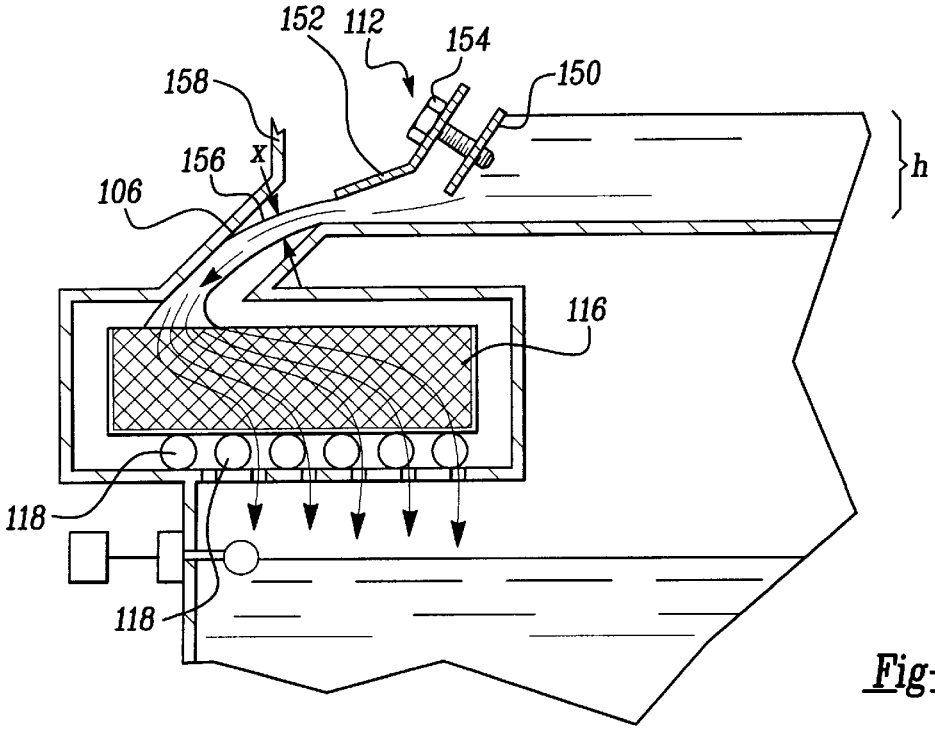
FIG. 5 is an expanded view of the fluid feed weir of the rinse sump.

A particularly advantageous feature of this invention will be described with respect to FIGS. 4 and 5. FIGS. 4 and 5 show an enlarged view of rinse sump 86 and weir restriction 112. As described above, head 108 of rinse water returned from spray washers 46 forms on shed tray 104. Water under pressure from head 108 flows through weir restriction 112. Weir restriction 112 comprises a diverter wall 150 which is fixed to rinse sump 86. An adjustable flood gate 152 attaches to diverter wall 150 using a screw adjust 154. Diverter wall 150 and flood gate 152 each include a threaded bore which receives a threaded screw to form screw adjust 154. Varying screw adjust 154 moves flood gate 152 generally vertically and somewhat horizontally in order to vary the width X of the flow restriction through which rinse water of head 108.

Head 108 creates a pressure so that fluid flow through restriction X generates a sheet of rinse water 156 which seals inlet 106 to enable pressurization of rinse sump 86. Preferably, sheet 156 of rinse water strikes rinse sump 86 in proximity to the intersection 158 of a generally vertical wall and a generally diagonal wall. One skilled in the art will recognize, that the height of h of head 108 and the width X of weir restriction 112 cooperate to vary the pressurizing force of sheet 156 of rinse water. Sheet 156 thus provides a pressure seal for rinse sump 86. The pressure seal enables pressurization of the interior of rinse sump 86, thereby assisting in the evaporation/condensation process. The fluid seal described herein also yields a safety advantage by creating a seal that may be easily broken during an over-pressure condition, thereby minimizing hazardous conditions inherent in pressurized vessels.

From the foregoing, one can see that the above-described invention offers several benefits. In particular, this invention provides a sealed rinse sump which may be pressurized to facilitate 'the evaporation/condensation process. The evaporation/condensation process enables the rinse water to be continuously cleaned, thereby increasing the throughput of the rinse system by minimizing down-time and providing a consistent, continuous supply of rinse water. Further, the above-described invention enables for the safe pressurization of the rinse sump by providing a fluid seal which may be safely broken in over-pressure conditions.

While specific embodiments have been shown and described in detail to illustrate the principles of the present invention, it will be understood that the invention may be embodied otherwise without departing from such principles. For example, one skilled in the art will readily recognize from such discussion and from the accompanying drawings and claims that various changes, modifications and variations can be made therein without departing from the spirit and scope of the invention as described in the following claims.

What is claimed:

1. A rinse station for a system for rinsing components in a spray washer comprising:

a rinse area;

a generally sealed reservoir for holding rinse fluid, the reservoir having an outlet for providing rinse fluid to the rinse area and an inlet for receiving fluid from the rinse area;

a fluid return section, the fluid return section collecting rinse fluid from the rinse area and returning the rinse fluid to the inlet of the reservoir;

a fluid seal formed at the inlet of the reservoir with fluid returned by the fluid return section, the fluid seal enabling pressurization of the reservoir;

a boil chamber receiving fluid from the reservoir, the boil chamber heating the rinse fluid to cause evaporation of the rinse fluid; and a condenser for condensing the evaporated rinse fluid, wherein the condensed fluid is returned to the reservoir.

2. The apparatus of claim 1 wherein the fluid seal further comprises a fluid restriction having an inlet and an outlet, wherein fluid at the restriction inlet is under a pressure sufficient to cause the restriction outlet to generate an output stream to provide the fluid seal.

3. The apparatus of claim 2 wherein the fluid seal provides a pressure seal that varies in accordance with the pressure at the inlet fluid restriction and a width of the restriction.

4. The apparatus of claim 1 wherein the reservoir and boil chamber are integrally formed and further comprising a partition between at least a portion of each of the reservoir and the boil chamber, wherein rinse fluid stored in the reservoir overflows the partition to enter the boil chamber.

5. The apparatus of claim 4 wherein the condenser is formed within the integral reservoir and boil chamber in a space above the partition.

6. The apparatus of claim 5 wherein the boil chamber is placed between the reservoir and the condenser.

7. The apparatus of claim 1 wherein the boil chamber further comprises a heater for elevating a temperature of the rinse fluid.

8. The apparatus of claim 7 wherein the condenser further comprises a plurality of coils, wherein fluid circulates within the coils at a temperature sufficient to cool the coils to cause condensation of the evaporated rinse fluid on the coils.

9. The apparatus of claim 1 wherein the inlet is located opposite the outlet, and wherein the condenser returns fluid in proximity to the outlet.

10. The apparatus of claim 9 further comprising a pump for circulating fluid from the reservoir outlet to the rinse area.

11. A spray washer comprising:

a conveyor for transporting components to be cleaned by the spray washer;

a wash station through which the conveyor passes, the wash station circulating wash fluid over the components, the wash station having a reservoir for collecting and recirculating the wash fluid; and a rinse station through which the conveyor passes following the wash station, the rinse station circulating rinse fluid over the components, the rinse station having a reservoir for collecting and recirculation the rinse fluid; and a fluid seal formed at an inlet of the reservoir with rinse fluid, the fluid seal including a fluid restriction having an inlet and an outlet, wherein fluid at the restriction inlet is under a pressure sufficient to cause fluid at the restriction outlet to generate an output stream to provide the fluid seal.

12. The apparatus of claim 11 wherein the rinse station further comprises:

a fluid return section, the fluid return section collecting and returning the rinse fluid to the reservoir;

a boil chamber receiving fluid from the reservoir, the boil chamber heating the rinse fluid to cause evaporation of the rinse fluid; and a condenser for condensing the evaporated rinse fluid, wherein the condensed fluid is returned to the reservoir.

13. The apparatus of claim 12 wherein the fluid seal provides a pressure seal that varies in accordance with a pressure at the restriction inlet and a width of the restriction.

14. The apparatus of claim 12 wherein the reservoir and boil chamber are integrally formed and further comprising a partition between the reservoir and the boil chamber, wherein rinse fluid stored in the reservoir overflows the partition to enter the boil chamber.

15. The apparatus of claim 14 wherein the condenser is formed within the integral reservoir and boil chamber in a space above the partition.

16. The apparatus of claim 15 wherein the boil chamber is placed between the reservoir and the condenser.

17. The apparatus of claim 12 wherein the boil chamber further comprises a heater for elevating a temperature of the rinse fluid.

18. The apparatus of claim 12 wherein the condenser further comprises a plurality of coils, wherein fluid circulates within the coils at a temperature sufficient to cool the coils to cause condensation of the evaporated rinse fluid on the coils.

* * * * *